US005564361A

United States Patent [19]

Satterwhite

[11] Patent Number: 5,564,361

[45] Date of Patent: Oct. 15, 1996

[54] CLOTHING USAGE INDICATOR

[76] Inventor: Carlette A. Satterwhite, 5902 Mount Eagle Dr., Unit 310, Alexandria, Va. 22303

[21] Appl. No.: 531,323

[22] Filed: Sep. 29, 1995

Related U.S. Application Data

[63] Continuation of Ser. No. 262,902, Jun. 21, 1994.

[51] Int. Cl.[6] ..... G09F 9/40; G09D 3/00

[52] U.S. Cl. ..... 116/308; 116/323; 40/109

[58] Field of Search ..... 116/224, 225, 116/306, 307, 308, 321, 322, 323, 324, 222, 223; 40/107, 110, 321, 109, 113

[56] References Cited

U.S. PATENT DOCUMENTS

| | | | |
|---|---|---|---|
| 859,210 | 7/1907 | Dixon . | |
| 934,507 | 9/1909 | Crane . | |
| 974,806 | 11/1910 | McQuinn . | |
| 1,156,345 | 10/1915 | Burnap . | |
| 1,354,983 | 10/1920 | Lloyd | 116/321 |
| 1,381,881 | 6/1921 | Lely | 40/109 |
| 2,814,267 | 11/1957 | Goldstein et al. . | |
| 3,124,284 | 3/1964 | Collum . | |
| 4,886,010 | 12/1989 | Stutzman . | |
| 5,129,352 | 7/1992 | Roberts | 116/308 |

FOREIGN PATENT DOCUMENTS

| | | | |
|---|---|---|---|
| 30297 | 11/1931 | Australia | 40/113 |
| 571648 | 1/1958 | Italy | 40/113 |

*Primary Examiner*—William A. Cuchlinski, Jr.
*Assistant Examiner*—Willie Morris Worth
*Attorney, Agent, or Firm*—Wigman, Cohen, Leitner & Myers, P.C.

[57] ABSTRACT

A clothing usage indicator including indicia representative of the days of the month, the days of the week, and the months of the year, with associated indicators that are movable along the edges and along interior slots in the device for indicating a particular day of the month, a particular day of the week, and a particular month of the year. The device includes a suitable connector for associating the device with an article of clothing, and preferably includes a loop or other device whereby the indicator can be slipped over the hooked end of a clothing hanger for association with a particular article of clothing.

21 Claims, 2 Drawing Sheets

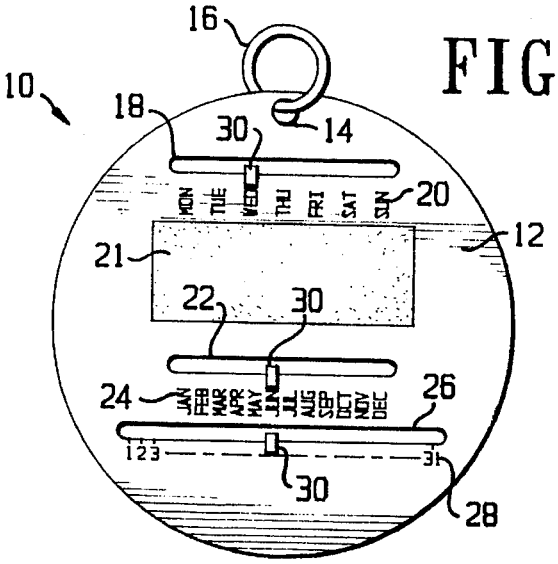
FIG. 1
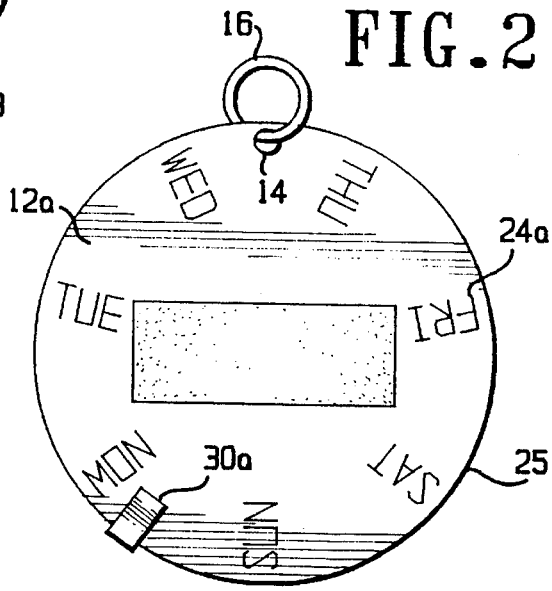
FIG. 2
FIG. 3
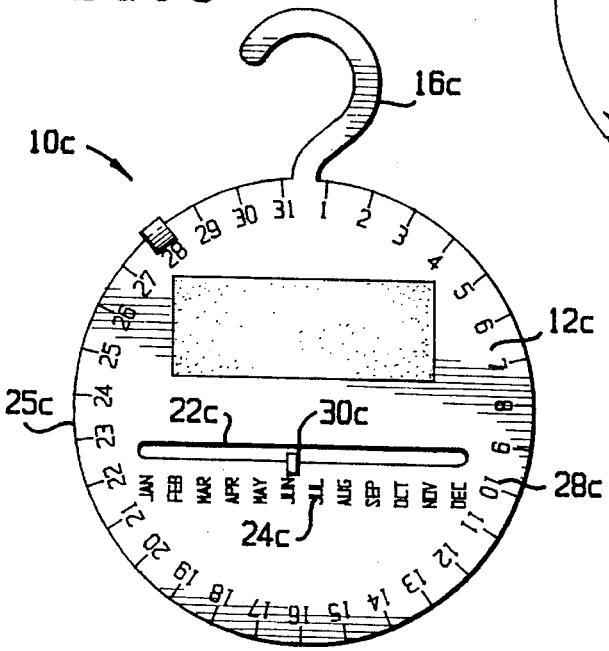
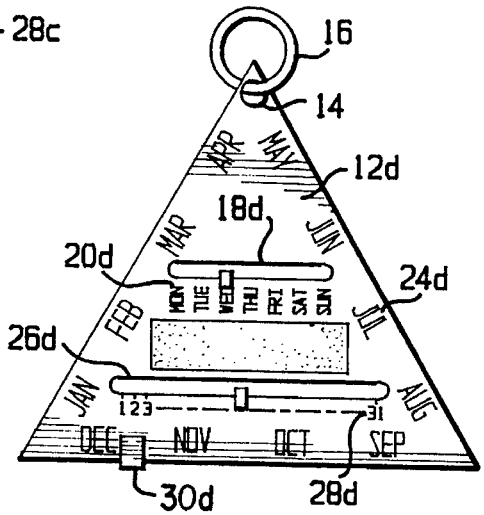
FIG. 4

CLOTHING USAGE INDICATOR

This is a continuation of co-pending application Ser. No. 08/262,902, filed on Jun. 21, 1994.

BACKGROUND OF THE INVENTION

1. Field of the Invention

The present invention relates to an indicator for indicating when a particular article of clothing has been worn. More particularly, the invention relates to a clothing usage indicator device having printed scales and movable indicators for identifying the day of the week, the day of the month, and the month on which an article of clothing was last worn. The device includes a suitable connector for associating the indicator with a particular article of clothing.

2. Background of the Related Art

Various types of indicators have been disclosed for identifying the number of times a particular article of clothing has been worn, principally for purposes of monitoring the need for washing or dry cleaning. Additionally, such numerical indicators have also been suggested as a way of enabling the balancing of wear between a number of similar articles of clothing, such as, for example, suits, so that one article does not undergo more wear than another. In that regard, U.S. Pat. No. 4,886,010, which issued Dec. 12, 1989, to Ralph Stutzman, discloses a clothing wear monitoring device including an indicator and a strap, the indicator carrying indicating means for displaying both the number of times a garment has been worn and also the year and month in which it was last cleaned. The device as disclosed can either be attached to or formed integrally with a clothing hanger.

In U.S. Pat. No. 3,124,284, which issued on Mar. 10, 1964, to Theodore J. Collum, there is disclosed a garment wear record in the form of a tally made from cardboard that is adapted to be folded over and to overlie the shoulder elements of a clothing hanger. The indicator includes a series of aligned, bendable tabs 30, and a tab is bent or folded each time the garment is worn, to thereby maintain a record of the frequency of wear of the garment.

The above-identified clothing monitoring devices are intended to permit a person to keep track of the number of times an article has been worn, to thereby serve as a reminder as to when dry cleaning might be needed. Additionally, it also permits a person to balance the usage of his or her wardrobe by indicating the number of times each of a group of similar garments has been worn, to thereby permit the person to balance the number of wearings of several garments, if desired. Although the devices identified above are generally suitable for their limited intended purpose, there are oftentimes other considerations that influence the frequency of wearing of a particular article of clothing. For example, when a person has a number of articles in his or her wardrobe, it is often difficult to remember when a particular article was last worn, so that too frequent wearing of that particular article can be avoided.

In addition to serving to supplement a person's memory of when a particular garment was last worn, a clothing usage indicator can also be useful to one afflicted with color blindness. When such a person has a number of similar garments that are of different colors, because of his or her color blindness the person might not be able to identify which of two articles of dissimilar color were last worn and when. Additionally, the previously-disclosed indicator devices would be of no help whatsoever to a blind person who wished to know when a particular garment had last been worn.

Accordingly, it is an object of the present invention to provide a clothing usage indicator for indicating at least the day of the week in which a garment was last worn.

It is another object of the present invention to provide a clothing wear indicator that can conveniently be associated with a particular article of clothing and is reusable.

SUMMARY OF THE INVENTION

Briefly stated, in accordance with one aspect of the present invention, a clothing usage indicator is provided in the form of a planar panel that contains indicia representing the days of the week, the days of the month, and the months of the year, together with suitable indicators associated with each of the indicia to identify a particular day of the week, a particular day of the month, and a particular month of the year, all representative of the day upon which an article was last worn. The present invention can be readily associated with a particular article of clothing and as such not only provides a record of usage, but also serves as an aid in identifying the particular article of clothing to assist a colorblind or blind user.

BRIEF DESCRIPTION OF THE DRAWINGS

FIG. 1 is a front view of a first embodiment of a clothing usage indicator in accordance with the present invention;

FIG. 2 is a view similar to FIG. 1, showing a second embodiment of the present invention;

FIG. 3 is a view similar to FIG. 1, showing a third embodiment of the present invention;

FIG. 4 is a view similar to FIG. 1 showing a fourth embodiment of the present invention in the form of a triangular panel;

DESCRIPTION OF THE PREFERRED EMBODIMENTS

Figure 5:
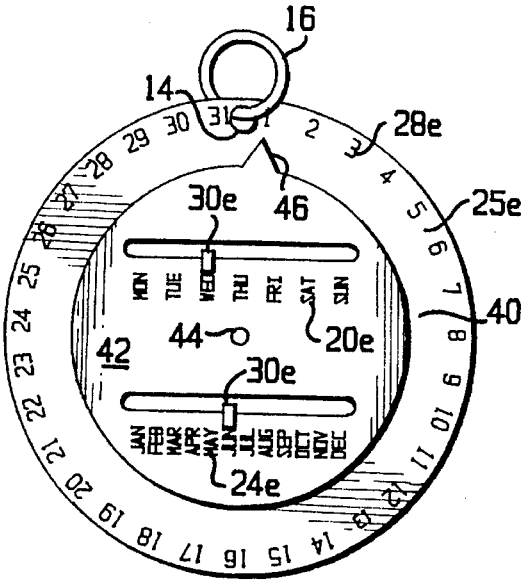
FIG. 5 is a view similar to FIG. 1, showing a fifth embodiment of the present invention in the form of a pair of relatively rotatable concentric circles of differing diameters.

Referring now to the drawings, and particularly to FIG. 1 thereof, there is shown a front view of a clothing usage indicator 10 in the form of a planar panel 12 that can be made of paperboard, plastic, lightweight sheet metal or the like. As shown, panel 12 is of circular form, although it could also be of rectangular, oval, or any other convenient form. Panel 12 includes an aperture 14 through which a connector 16 in the form of a loop of string, ribbon, wire or the like, is provided to permit connector 16 to be slipped over the hooked-end of a clothes hanger. Alternatively, a safety pin (not shown) or other pin could also be used, if desired, as can a panel extension (not shown) with a slot through which the hooked portion of the clothes hanger can be passed. In another alternative of the hanger, a pocket panel (see FIG. 6) can be provided for placement in a garment pocket.

Planar panel 12 includes printed indicia in several forms: the seven days of the week, the days of the month, and the months of the year. Of course, for articles of specialty clothing which are worn infrequently, even the year can be provided. Each of the indicia is associated with a slot or opening in the planar panel along which a slidable indicator is movable either to overlie or to point to a particular day of the week. Thus, as shown in FIG. 1, linear slot 18 extends across panel 12 and printed adjacent slot 18 are indicia 20 identifying the names, or abbreviations, of the days of the week.

Below the day of the week indicia is a second slot 22, which also extends across panel 12, and adjacent which are indicia 24 identifying the names, or abbreviations, of the months of the year. Additionally, provided below second slot 22 is a third linear slot 26, adjacent which indicia 28 identifying by number each of a maximum of 31 days of a month. Because of the space required for the days of the month indicia, it may be more convenient that they be divided into two separate and distinct rows, for example, 1 through 15 in the first row and 16 through 31 in the second row.

Figure 7:
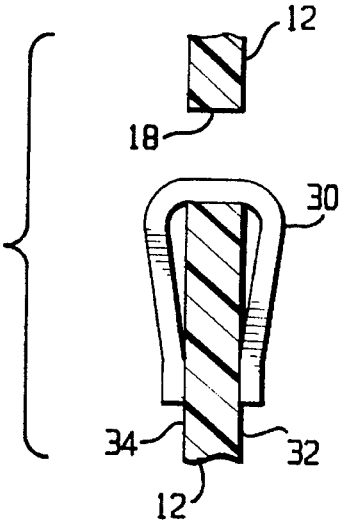
FIG. 7 is an enlarged, fragmentary, cross-sectional view taken through a typical slot along which a pointer is movable, as provided in the first, third, fourth and fifth embodiments.

A suitable pointer or other indicator is provided for slidable movement to point to the particular day, month, and date on which an article has last been worn. As shown in FIG. 7, one form of pointer can be a folded-over rectangular plastic slider 30 that is movable along slot 18, for example. Preferably, slider 30 has been so formed that it resiliently contacts both front surface 32 and rear surface 34 of panel 12 so that it remains in the position to which it has been slidably shifted by the user.

As shown in FIG. 1, either above or below the month of the year indicia 24 is preferably provided a rectangular, blank, preferably unprinted area 21, the purpose of which is to permit the writing by the user of the device of notes or reminders pertaining to the article, or perhaps to identify social events at which the article was worn. For example, the owner could note a specific event or social function at which the article was worn, in order to avoid wearing the same garment at a similar social function at some time in the future.

As shown in FIG. 1, the slots 18, 22 and 26 are arranged as linear slots across the planar panel 12. However, arcuate or other shapes of the slots can also be used in which the pointers 30 can be movably mounted.

In use, indicator device 10 is associated with a particular article of clothing, which can be noted on the note portion of the device, or on the reverse side. After an article is worn, the indicator associated with the day of the week on which the article was worn is moved to the appropriate day, the indicator associated with the month of the year is moved to the appropriate month, and the day of the month indicator is moved to the appropriate date. Should the user not desire to utilize each of the separate indicators available, a blank or zero designation can be provided. Indicator 10 is then associated with the garment either by pinning the indicator to the garment or, alternatively, by slipping loop 16 over the hooked end of a hanger on which the article is maintained. When similar indicators have been associated with other articles in the owner's wardrobe, one can tell at a glance when a particular article of clothing has last been worn, to avoid excessively frequent wearings, or to avoid wearing of the same garment at two very similar social functions or within a short span of time.

Other embodiments of the present invention are illustrated in FIGS. 2 through 5. In FIG. 2, the day of the week indicia **24*a* are provided along the outer periphery 25 of circular planar panel 12*a*, with a movable indicator 30*a* slidable along the periphery to the appropriate day. Although the FIG. 2 embodiment includes only the day of the week indicia 24, if desired the other indicia shown in FIG. 1 can be positioned in the same relative positions as they are shown in the FIG. 1 embodiment, or alternatively, in arcuate slots provided in the panel 12*a***.

In the embodiment of FIG. 3, the day of the month indicia **28*c* are printed along the periphery 25*c* of planar element 12*c* and the month of the year indicia 24*c* are oriented in a manner similar to their orientation in the embodiment shown in FIG. 1, with indicator 30*c* slidable along slot 22*c*. The FIG. 3 embodiment also illustrates an alternate form of connector 16*c* in the form of an integral hook for attaching device 10*c*** to a clothes hangar.

In the embodiment of FIG. 4, planar panel **12*d* is provided in triangular form with the months of the year indicia 24*d* printed along the edges of the device, with a slidable indicator 30*d* movable linearly along the respective edges of the device. Again, the day of the week indicia 20*d* and the day of the month indicia 28*d* are provided within the perimeter of the device with suitable indicators movable along respective slots 18*d* and 26*d*, similar to the FIG. 1** embodiment.

The embodiment shown in FIG. 5 is similar to that shown in FIG. 3 in that the day of the month indicia **28*e* are printed along the periphery 25*e* of an outer circular panel member 40. However, the day of the week indicia 20*e* and the month of the year indicia 24*e* are printed on an inner circular panel member 42 that overlies panel member 40 and is rotatable relative thereto by virtue of a connecting rivet (or pin) 44 that permits the members to be rotated. Additionally, inner panel member 42 can include an integral peripheral pointer 46 to be aligned with the month indicia 28*e*, as shown in FIG. 5**.

Figure 6:
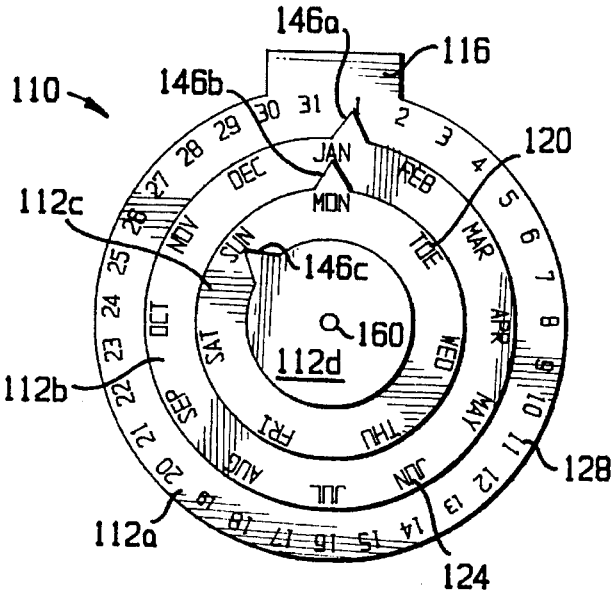
FIG. 6 is a view similar to FIG. 1, showing a sixth embodiment of the present invention in the form of four relatively rotatable nested concentric circular members of differing diameters.

An alternative embodiment is shown in FIG. 6. Therein, a clothing usage indicator 110 is shown having four nested concentric rotatable circular planar panels. First, outer panel **112*a* bears indicia 128 indicative of the days of the month. Second panel 112*b* bears indicia corresponding to the months of the year and integral pointer 146*a* which is used to point to a specific day of the month on first panel 112*a*. Third panel 112*c* bears indicia corresponding to the days of the week and pointer 146*b* which is used to point to a specific month on second panel 112*b*. Fourth panel 112*d* bears pointer 146*c* which is used to point to a specific day of the week on third panel 112*c*. A rivet 160 or other pivotal fastener is provided at the center of the panels to permit relative rotation of the panels to align the panels and pointers to indicate a specific day of the week, day of the month and month. A folded panel 116 is provided having an end flap to be placed in the pocket of the article of clothing. A specific sequence of indicia is shown in FIG. 6**. Of course, the sequence of indicia can be altered in this embodiment to encompass a different sequence.

In addition to providing the respective indicia in printed form on one face of the planar panel, the present invention contemplates the indication on the panel of the respective days of the week, the days of the month, and the months of the year in braille (or other embossed or relief form) so that the device can be utilized by blind persons. Furthermore, provision can be made for indicating the color to assist a colorblind person. The writing surface can be made to be readily erasable. Alternatively, space can be provided for other printing such as advertising.

Although preferred embodiments of the clothing usage indicator of the present invention have been specifically described herein, it will be apparent to those skilled in the art to which the invention pertains that variations and modifications of the described embodiments may be made without departing from the spirit and scope of the invention. Accordingly, it is intended that the invention be limited only to the extent required by the appended claims and the applicable rules of law.

What is claimed is:

1. A clothing usage indicator for indicating when a particular article of clothing was last worn, said usage indicator comprising:

(a) at least one planar panel member having provided thereon first indicia selected from the group of indicia consisting of the days of the week, the days of the month and the months of the year;

(b) a first indicator slidably engaging said planar panel and associated with the first indicia, thereby indicating either a specific day of the week, a specific day of the month or a specific day of the year, on which the article of clothing was last worn, wherein the first indicia are printed adjacent the periphery of the planar panel member and wherein the first indicator is movable relative to the periphery of the planar panel; and (c) attachment means extending from said planar panel member for attaching the usage indicator in association with the article of clothing.

2. A clothing usage indicator in accordance with claim 1 wherein the planar panel member has provided thereon a second indicia different from the first indicia and selected from the group of indicia consisting of the days of the week, the days of the month, and the months of the year, and a second indicator means associated with the second indicia and movably carried by said planar panel member, thereby indicating either a specific day of the week, a specific day of the month, or a specific month of the year on which the article of clothing was last worn.

3. A clothing usage indicator in accordance with claim 2 wherein the planar panel member has provided thereon a third indicia different from the first and second indicia and selected from the group of indicia consisting of the days of the week, the days of the month and the months of the year, and a third indicator associated with the third indicia and movably carried by the planar panel member for indicating either a specific day of the week, a specific day of the month or a specific month of the year within which the article of clothing was last worn.

4. A clothing usage indicator in accordance with claim 1 wherein the planar panel member is substantially circular and the first indicia are printed adjacent the periphery of said planar panel member, and wherein the first indicator is movable relative to the periphery of the usage indicator to indicate a specific day of the week.

5. A clothing usage indicator as in claim 1, wherein said first indicator is carried in an arcuate slot.

6. A clothing usage indicator as in claim 2, wherein said second indicator is carried in an arcuate slot.

7. A clothing usage indicator as in claim 3, wherein said third indicator is carried in an arcuate slot.

8. A clothing usage indicator for indicating when a particular article of clothing was last worn, said usage indicator comprising:

(a) a planar panel having provided thereon first indicia indicative of the days of the month and second indicia indicative of the months of the year;

(b) first indicator means slidably engaging the panel and associated with the first indicia for indicating a specific day of the month on which the article of clothing was last worn, and second indicator means slidably engaging the panel and associated with the second indicia for indicating the month of the year within which the article of clothing was last worn, wherein at least one of said first indicator means and corresponding first indicia and said second indicator means and corresponding second indicia are located on the periphery of the panel; and (c) attachment means extending from the panel for attaching the usage indicator in association with the article of clothing.

9. A clothing usage indicator in accordance with claim 8 wherein the first indicia are positioned along the periphery of the planar panel member and the second indicia are positioned linearly on the panel member.

10. A clothing usage indicator in accordance with claim 3 wherein the panel member is triangular and the third indicia are positioned along the periphery of the panel member.

11. A clothing usage indicator in accordance with claim 3 wherein each indicator means is slidable along the planar panel and resiliently engages the planar panel to remain in a position to which the indication means has been moved by a user.

12. A clothing usage indicator in accordance with claim 1 wherein the planar panel member includes an integral writing surface to enable notes to be written thereon.

13. A clothing usage indicator as in claim 1, wherein said first indicia is in braille.

14. A clothing usage indicator as in claim 2, wherein said second indicia is in braille.

15. A clothing usage indicator as in claim 3, wherein said third indicia is in braille.

16. A clothing usage indicator as in claim 1, wherein said first indicia is printed.

17. A clothing usage indicator as in claim 2, wherein said second indicia is printed.

18. A clothing usage indicator as in claim 3, wherein said third indicia is printed.

19. A clothing usage indicator for indicating when a particular article of clothing was last worn, said usage indicator comprising:

(a) at least one planar panel having provided thereon (i) a first indicia of clothing wear usage selected from the group of indicia consisting of the days of the week, the days of the month and the months of the year, and a first indicator slidably engaging said planar panel and associated with the first indicia, thereby indicating either a specific day of the week, a specific day of the month or a specific day of the year, on which the article of clothing was last worn;

(ii) a second indicia of clothing wear usage different from the first indicia and selected from the group of indicia consisting of the days of the week, the days of the month, and the months of the year, and a second indicator means associated with the second indicia and slidably engaging said planar panel, thereby indicating either a specific day of the week, a specific day of the month, or a specific month of the year on which the article of clothing was last worn;

(iii) a third indicia of clothing wear usage different from the first and second indicia and selected from the group of indicia consisting of the days of the week, the days of the month and the months of the year, and a third indicator associated with the third indicia and slidably engaging the planar panel for indicating either a specific day of the week, a specific day of the month or a specific month of the year within which the article of clothing was last worn, wherein at least one indicia and one corresponding indicator are located on the periphery of said planar panel member; and (b) attachment means extending from said planar panel member for attaching the usage indicator in association with the article of clothing.

20. A method of providing an indication of when a particular article of clothing was last worn, comprising the steps of:

indicating at least one of the day of the week, the day of the month and the month of the year on which the article of clothing was last worn, thereby providing an indication of when the article of clothing was last worn, said indication provided by a device having movable indicators and corresponding indicia, and physically associating the device with the particular article of clothing.

21. A method of indicating when a particular article of clothing was last worn, comprising the steps of:

indicating by using a device having movable indicators and corresponding indicia, at least one of the day of the week, the day of the month and the month of the year on which the article of clothing was last worn, and physically associating the device with the particular article of clothing by attaching the device to garment hangers.

* * * * *